US005577778A

United States Patent [19]

Parietti et al.

[11] Patent Number: 5,577,778

[45] Date of Patent: Nov. 26, 1996

[54] NECK TIE TYING TOOL

[76] Inventors: Michael I. Parietti, 8449 Oakton La., Apt. 3A, Ellicott City, Md. 21043; Frank K. Parietti, 6 Spook Rock Rd., Suffern, N.Y. 10901

[21] Appl. No.: 452,105

[22] Filed: May 26, 1995

[51] Int. Cl.[6] ..... B65H 69/04

[52] U.S. Cl. ..... 289/17; 2/148; 2/152.1; 223/83

[58] Field of Search ..... 2/144, 145, 146, 2/148, 152.1; 223/81, 82, 83, 111; 289/1.5, 2, 17, 18.1

[56] References Cited

U.S. PATENT DOCUMENTS

| | | | |
|---|---|---|---|
| 2,148,582 | 2/1939 | Rodgers | 223/111 |
| 2,208,695 | 7/1940 | Fallon | 223/111 |
| 2,653,325 | 9/1953 | McCarthy | 2/148 |
| 3,752,374 | 8/1973 | Pro | 223/111 |
| 4,173,792 | 11/1979 | Intengan | 2/144 |
| 5,216,757 | 6/1993 | Dorkin | 2/144 |
| 5,390,370 | 2/1995 | Koy | 2/148 |
| 5,416,926 | 5/1995 | Koy | 2/145 |

*Primary Examiner*—Michael A. Neas

[57] ABSTRACT

A tool (10) is provided for creating an indentation or furrow in the portion of a neck tie (20) that flows down and out of the knot (22) formed when the neck tie is tied around a human neck. The tool includes a sheet of flexible material (12) that is bent, folded or curved along midline so as to create a concave and convex surface in the approximate shape of a hollow half cylinder without ends or a piece of tubing split in half along its length. A fin (14) runs along the midline of the sheet of flexible material on its concave surface and bisects the cavity created by the concave surface of the sheet of flexible material. An elongate probe, (16) projects from one end of the fin. The end of the elongate probe (18) is inserted into the bottom of the untightened knot in the necktie and pushed upward until it protrudes from the top of the knot. The fin and concave surface of the sheet of flexible material are then pressed into the surface of the tie that hangs below the knot and faces out and away from the chest. The tie is then formed around the fin and pushed up into the cavities on either side of the fin on the concave side of the sheet of flexible material thereby forming an indentation or furrow in the tie just below the knot.

1 Claim, 8 Drawing Sheets

NECK TIE TYING TOOL

TECHNICAL FIELD

This invention relates to personal appearance, attire and in particular to an attractively tied necktie.

BACKGROUND OF THE INVENTION

The proper wear of attire and clothing in an attractive and stylish manner is an important part of personal grooming. Much time and money is spent on preparing the appearance and style of ones clothing. An entire industry has developed full of products and services to fulfill this demand. The appearance of the necktie is an important part of the appearance of one's overall attire. The appearance of the knot used to tie the necktie is an important part of the appearance of the necktie and the overall appearance of one's attire.

As the pace of life continues to accelerate there is an increasing desire to minimize the time required to get dressed and attired in an attractive way and in particular to tie a necktie with an attractive and stylish knot. Therefore a need exists for an apparatus and method which assist in the tying of neckties and the creation of an attractively tied necktie knot, in a minimum amount of time.

BACKGROUND-DESCRIPTION OF PRIOR ART

No relevant prior art was found.

SUMMARY OF THE INVENTION

In accordance with one aspect of the present invention a tool is provided for creating an indentation or furrow in the portion of a necktie that flows down and out of the knot tied in the necktie. The tool has a sheet of flexible material bent along its midline so as to create a concave and convex surface. A keel like fin is attached to the concave surface of the sheet of material and runs along the length of its midline. An elongate probe is attached to one end of the fin.

In accordance with another aspect of the present invention, the elongate probe is preferably a cylinder coming to a rounded point at the first end.

In accordance with another aspect of the present invention a method is provided for creating an indentation or furrow in the portion of a necktie that flows down and out of the knot used to tie the necktie around the neck. The method includes the step of inserting the elongate probe of a tie tool into the knot tied in a necktie once the necktie has been tied around the neck but before it has been tightened down. The probe is inserted into the underside of the still loose knot. The method continues with the step of placing the fin of the tie tool against the surface of the tie below the knot and then forming the necktie up around the fin and into the cavities formed on each side of the fin and the concave surface of the sheet of flexible material on the tie tool. This helps to form an indentation in the surface of the necktie. The method continues with the step of grasping the tie tool with a first hand on the convex surface of the sheet of flexible material and compressing the opposing sides in ward towards each other and the fin. This holds the necktie formed around the fin and in the cavities and provides a firm grip on the necktie. The method continues with the step of pulling downward on the tie tool until the tip of the elongate probe is about to be withdrawn from the bottom of the knot. This helps to tighten the knot and create an indentation in the surface of the necktie. The method continues with the step of halting the downward pull, easing ones grip on the tie tool just enough to allow one to slide the tie tool upward towards the knot along the length of the tie while still keeping the necktie formed against the fin and the concave surface of the sheet of flexible material that is part of the tie tool. At this point the grasp of the first hand is retightened, and the tie tool is compressed again. This process is repeated until the knot is almost completely tightened down and an indentation has been created in the surface of the necktie that flows down and out the knot. At this point the tie tool is removed and the knot is pulled and cinched down tight.

A BRIEF DESCRIPTION OF THE DRAWINGS

A more complete understanding of the invention can be had by referring to the following Detailed Description taken with the accompanying drawings, wherein.

REFERENCE NUMERALS IN DRAWINGS

| | |
|---|---|
| 10 tie tool | 12 sheet of material |
| 14 fin | 16 elongate probe |
| 18 first end of elongate probe | 20 fore and hand neck tie |
| 22 knot in neck tie | 24 first hand |
| 26 second hand | 28 directional arrow |
| 30 directional arrow | |
| 32 position of sheet of material when compressed. | |

DETAILED DESCRIPTION

Figure 1:
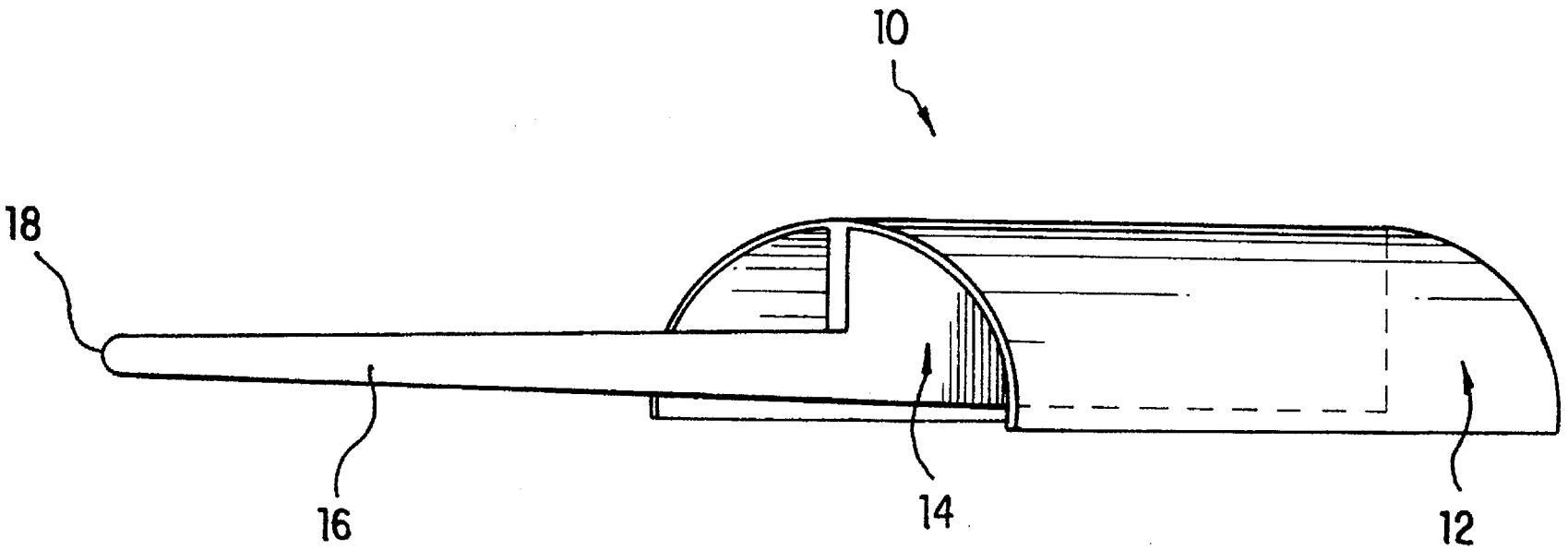
FIG. 1 is a side perspective view forming a first embodiment of the present invention.
Figure 2:
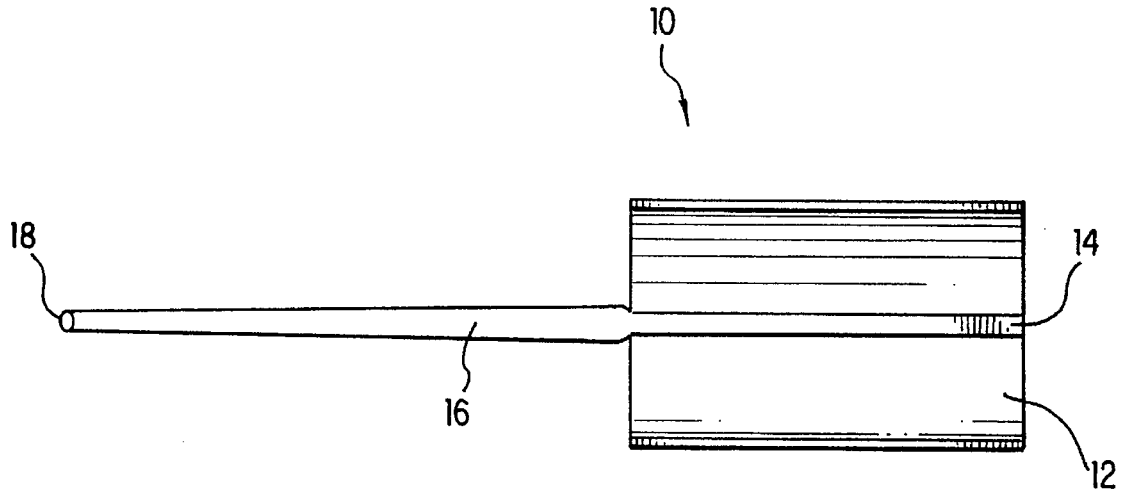
FIG. 2 is a view of the underside view of the first embodiment of the present invention.
Figure 3:
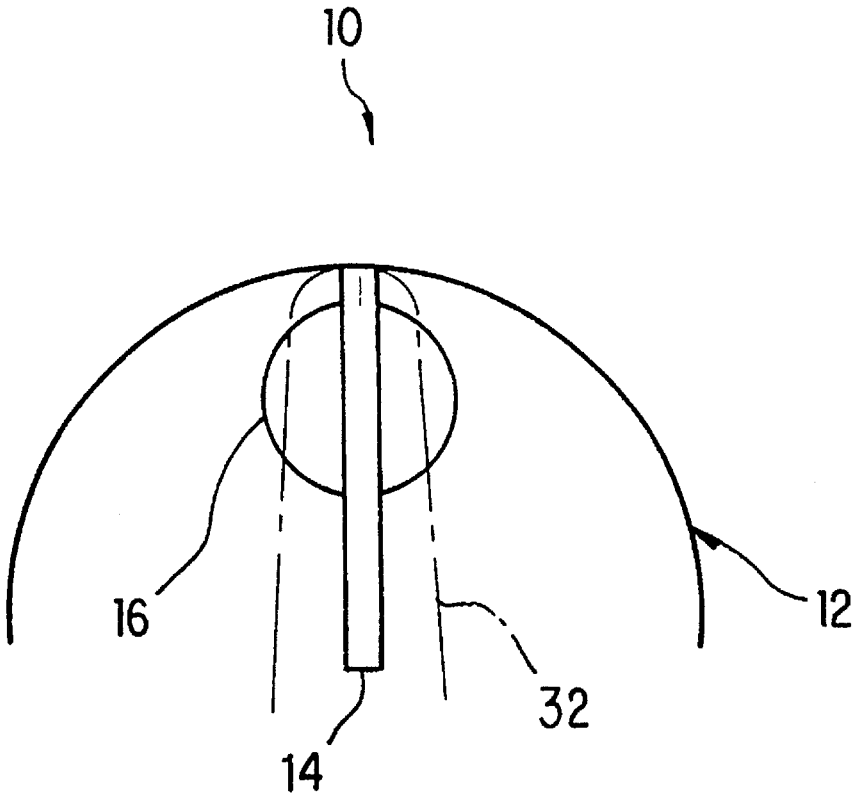
FIG. 3 is an end view of the first embodiment of the present invention.

Referring to the drawings now wherein like reference numerals designate like or corresponding parts throughout the several views, and in particular to FIG. 1 there is illustrated a tool 10 forming a first embodiment of the present invention. The tool 10 includes a sheet of flexible material 12, bent, folded or curved along its midline so as to create a concave surface and a convex surface. This sheet of flexible material is in the approximate shape of a hollow, half cylinder with open ends or a straight tube split in half along its length. The sheet of material, 12, is preferably made of a resilient material such as plastic, which can deform under the influence of external forces, but rebound to its hollow, half cylinder or horseshoe like shape when those forces have been removed. The sheet is also of sufficient size to be grasped by a human hand. A fin or keel like structure, 14, is attached to the inside or concave surface of the sheet of flexible material 12. The fin 14 runs along the length of the midline of the sheet of flexible material 12 and bisects it into two halves, sides or wings. It also bisects the cavity that is created by the concave surface of the sheet of flexible material into two equal cavities. A relatively elongate and inflexible probe 16 which narrows to a point at a first end thereof, 18, is attached to one end of the fin 14.

With reference now to FIGS. 4A through 4E the representation is made of a neck tie, 20, of the fore and hand type, tied around a human neck. As will be described hereinafter the tool 10 can be used to create an indentation or furrow in the outward facing surface of the necktie where it flows down and out of the knot used to tie it around the neck. To be as clear as possible, this indentation or furrow will be created in the surface of the tie that faces out to the public view or away from the wearers shin or chest. The indentation will be created in the portion of the neck tie just below the knot where the tie hangs down toward the ground or the wearers feet. This in turn will help create a attractive and stylish appearance of the necktie in general.

Figure 4A:
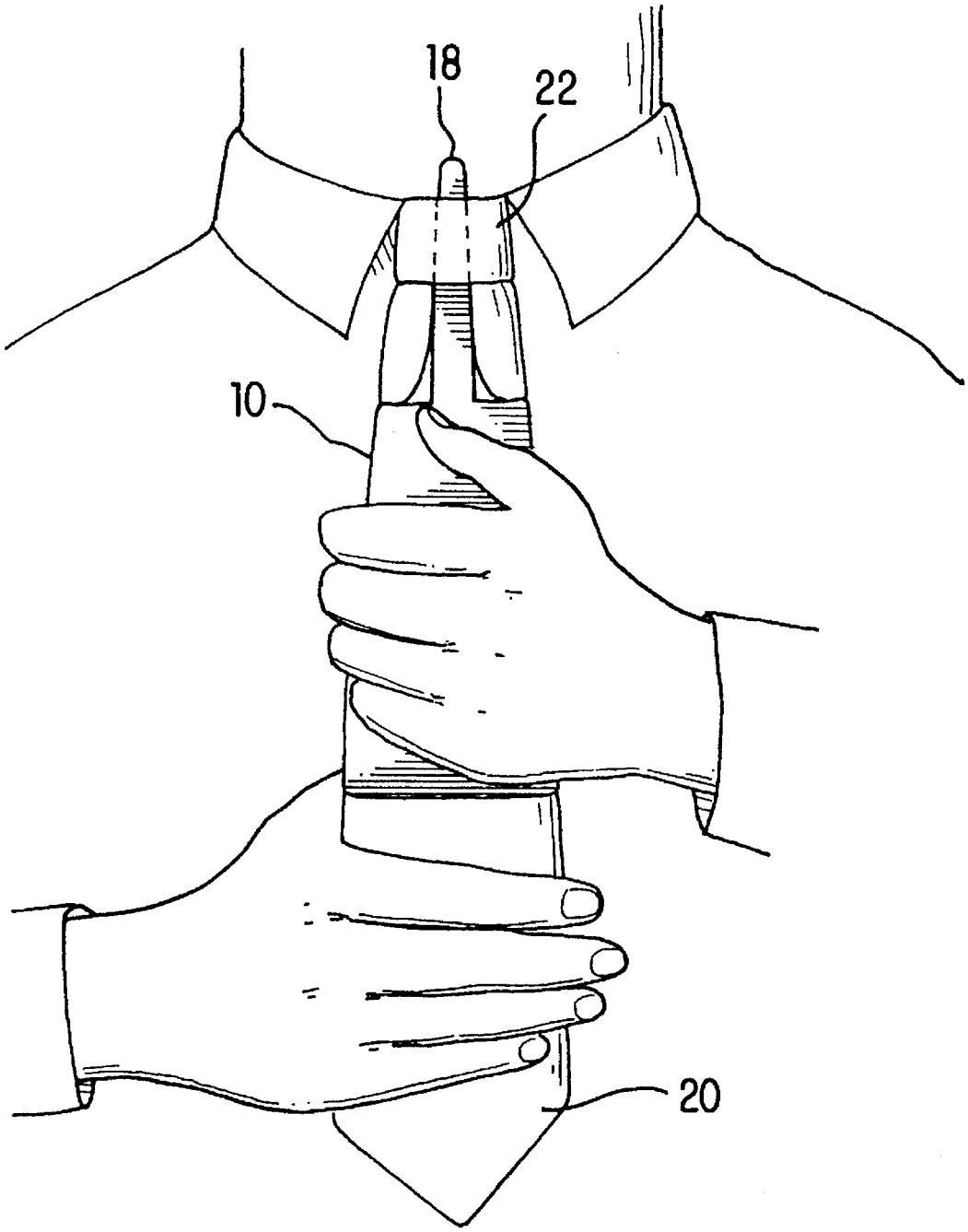
FIGS. 4A through 4C illustrate the use of the tie tool to create an indentation in a neck tie when tied around the neck.

To create the indentation in the neck tie the point 18 of the probe 16 is inserted into the bottom of the knot 22, in the necktie, the necktie being loosely tied around the neck but not yet tightened down completely, as shown in FIG. 4A. The elongate probe is pushed up through the knot until it protrudes out of the top. The point, 18, allows the probe to be inserted into the bottom of the knot and to glide into the knot with little friction and without pulling excessively on or catching on the tie itself. The probe helps creates an indentation in the outward facing surface of the portion of the neck tie that flows down and out of the knot, or the outward facing surface of the portion of the necktie just below the knot.

The fin, 14, is applied to the outward surface of the tie that will face out to the public view and away from the shirt or chest. The fin, 14, is centered on the tie and pressed down into the tie bisecting it vertically along its length. This helps to create a furrow or indentation in the necktie as shown in FIG. 4A. The portion of the necktie on either side of the fin, 14, is then pushed up by one's fingers and formed into the hollows or cavities on either side of the fin, 14, and along the inside or concave surface of the hollow, half cylinder shaped sheet of flexible material, 12, and thus helps to form a furrow or indentation in the necktie. This is shown in FIG. 4D.

Figure 4B:
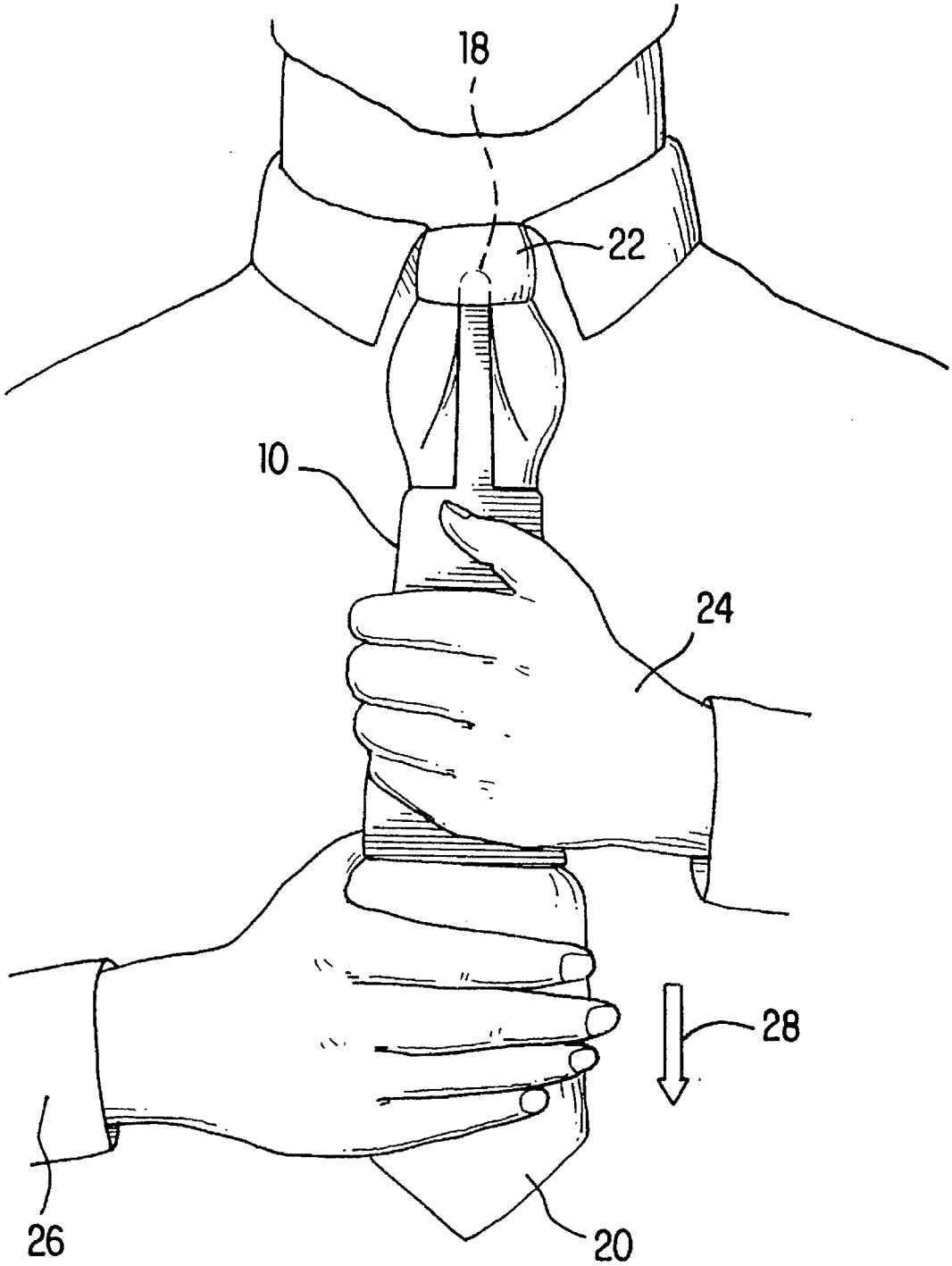

At this point the tool, 10, is grasped with a first hand, 24, on the convex surface of the sheet of flexible material 12 or the surface facing way from the neck tie, as shown in FIG. 4B. The flexibility of the hollow half cylinder shaped sheet of material, 12, allows one to compress the two opposing sides or wings inward toward each other and the fin. This is shown in FIG. 4E. The user will compress the sheet of flexible material inward in this fashion. This allows one to temporarily hold in shape, the indentation in the surface of the tie. The second hand, 26, is used to grasp the tail or the narrow end of the necktie with the thumb and fore finger, the thumb towards the chest or behind the tail of the necktie and the forefinger resting on surface of the tail of the tie that faces away from the chest. Both the thumb and the forefinger of the second hand, 26, are behind or underneath the wide end of the necktie. The middle finger of the second hand, 26, however rests on the outward facing surface of the wide end of the necktie, with the wide end of the necktie running in between the fore finger and the middle finger of the second hand, 26. Initially, the wide end of the necktie is not gripped by the forefinger and the middle finger of the second hand, 26, but only runs between these two fingers. While holding and grasping the tie tool in this fashion the user will pull down on the necktie in the direction of arrow 28 in FIG. 4B, so as to tighten the knot. The tool is used to pull the necktie downward until the end 18 of the probe 16 is about to slip out of the knot in the necktie. This will help to tighten down the knot and create an indentation or furrow in the portion of he necktie that flows down and out of the knot. At this point the downward pull is halted and the fore finger and middle finger of the second hand, 26, are squeezed or compressed together so as to grip the wide end of the necktie and hold it taut. This is shown in FIG. 4C.

Figure 4C:
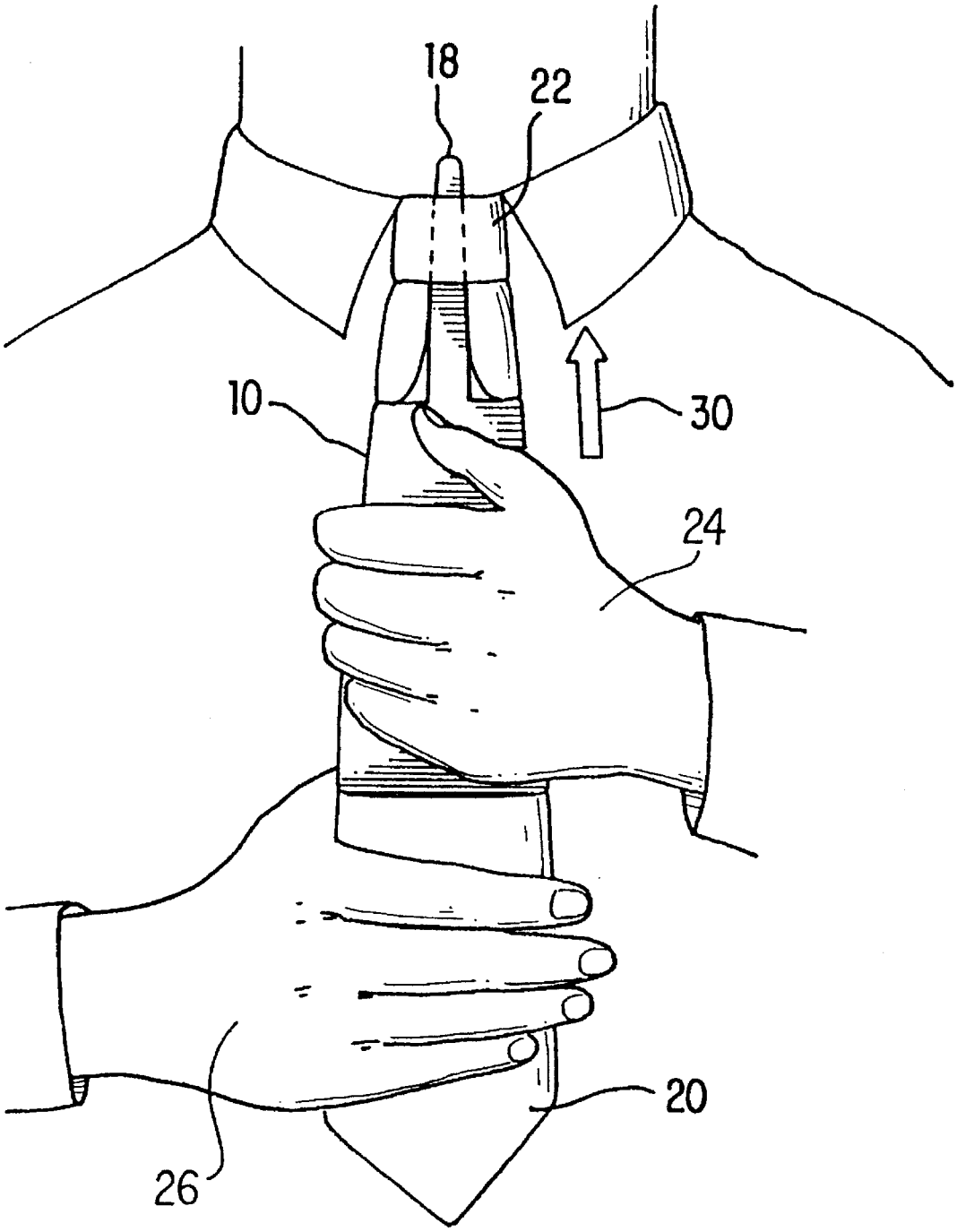
Figure 4D:
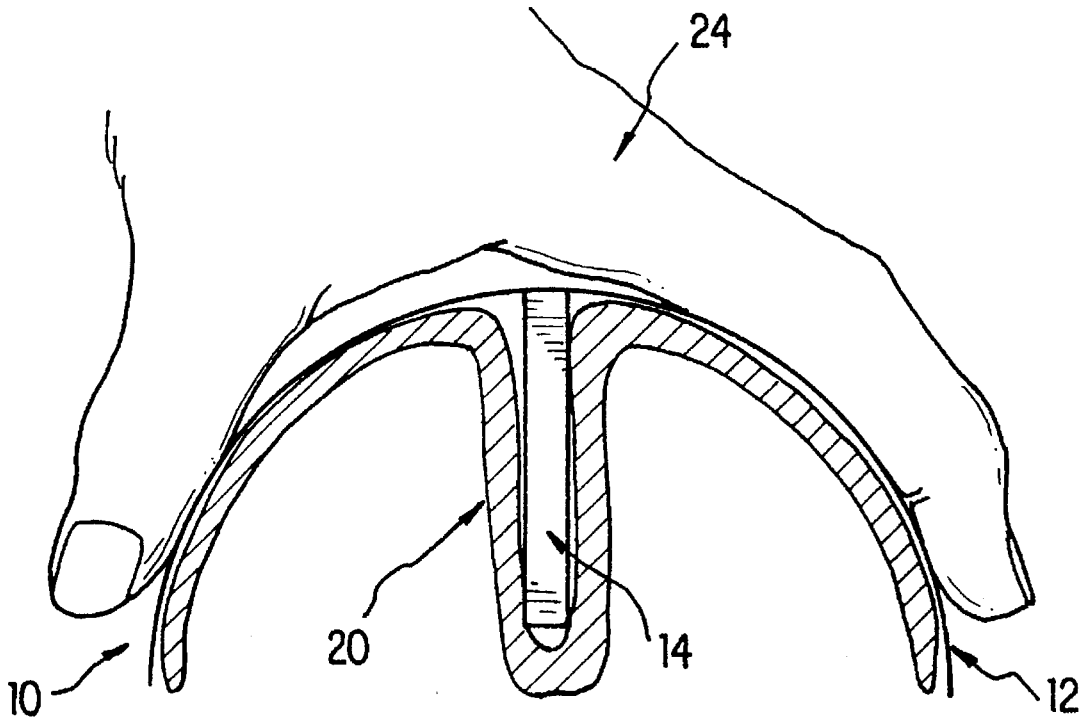
FIG. 4D is a cross sectional view of the first embodiment of the present invention as held by a human hand with a neck tie formed against it as it would be during usage.
Figure 4E:
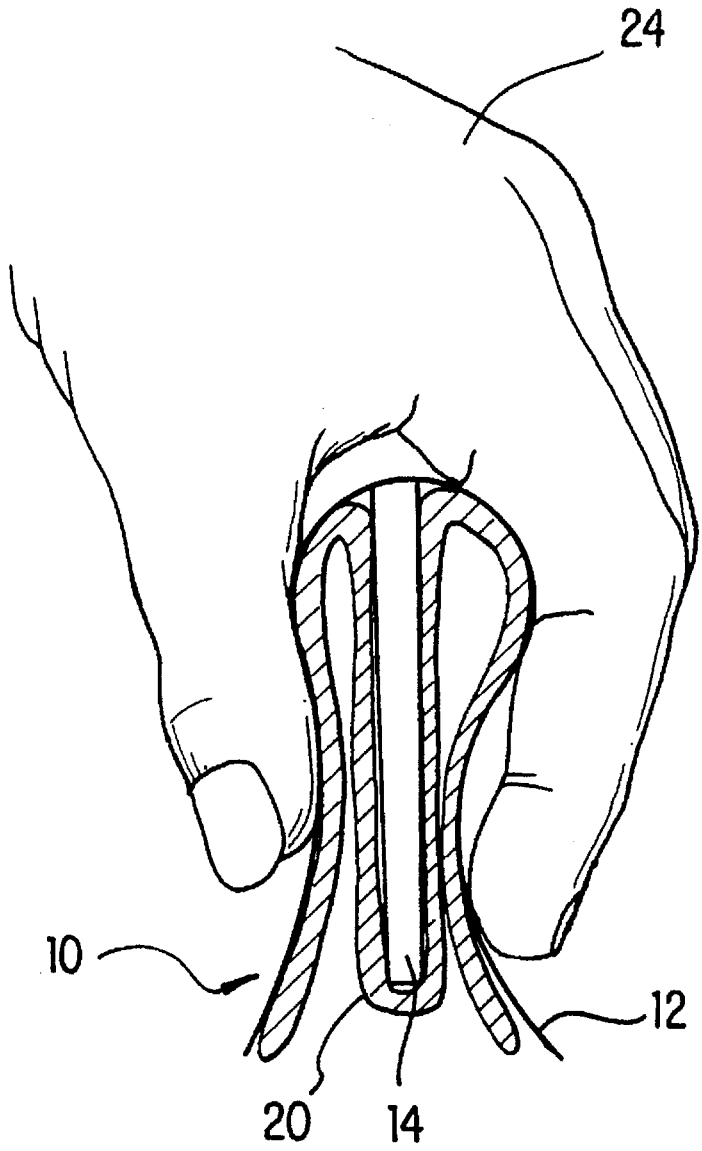
FIG. 4E is a cross sectional view of the first embodiment of the present invention held and compressed by a human hand with a neck tie formed against it as it would be during usage.

At this point one will ease his grip with the first hand, 24, on the convex surface of the sheet of flexible material, 12, just enough to allow him to slide the tool upwards along the necktie, in the direction of arrow 30 in FIG. 4C, while at the same time keeping an indentation in the surface of the necktie as it slides through the tie tool. In other words as the tie tool slides upward over the outward facing surface of the necktie it continues to keep an indentation in it. The tie tool is now slid upwards to its original position relative to the knot when the down stroke was commenced. The end of the probe 18 will again be protruding through the top of the knot. Once slid upward, the first hand, 24, will again grip the necktie tightly with the tie tool compressing the wings or sides of the hollow half cylinder inwards towards each other and the fin. Once again the tie tool is pulled downward in the direction of arrow 28. This step is repeated until the knot in the necktie is tightened almost all the way down and an indentation or furrow is created in the outward facing surface of the portion of the neck tie that flows down and out of the knot. At this point the tie tool is removed by releasing ones grip on the tool and pulling downward so as to remove the tip, 18, of the probe from the knot. The final step in the process is to grasp the tie with ones hand on either side of the created indentation or furrow and cinch the knot down tight. This will create a tightened knot with an indentation or furrow in the portion of the necktie that flows down and out of the knot.

CONCLUSION, RAMIFICATIONS AND SCOPE OF INVENTION.

Thus the reader will see that tie tying tool and method of the invention provides a simple, quick, and easy way to create an attractive and stylish indentation or furrow in the portion of the necktie that flows down and out of the knot when the neck tie is tied around the neck.

Depending on preference the tie tool 10 can be made as an integral unit of one material, such as plastic or in two or more parts, welded glued or otherwise secured together, which permits the sheet of flexible material or probe or fin to be made of different materials. For example, the sheet of flexible material could be made of resilient plastic or rubber while the probe or fin might be made of metal or semi rigid plastic.

While my above description contains many specifities, these should not be construed as limitations on the scope of the invention but rather as an exemplification of one preferred embodiment there of. Many other variations are possible. For example another embodiment would have the edges of the hollow half cylinder turned into the cavities on the concave surface like small lips. The edges of the necktie could be fitted or placed into these lips and they would help to hold the necktie in place. Another embodiment would have a flexible, malleable elongate probe that could be bent to different angles so as to create an indentation that was a little to the left or right or deeper than usual. The elongate probe would have a spring core or would be make out of a very malleable metal or alloy.

Another embodiment would be to have the tie tying tool without the elongate probe at all. Operation or this embodiment would be the same as the first embodiment except that there would be no probe to insert into the knot.

Accordingly, the scope of the invention should be determined not by the embodiments illustrated but by the appended claims and their legal equivalents.

We claim:

1. A tool for creating an indentation, dimple or furrow in a portion of a necktie that flows down and out of a knot in the necktie when the necktie is tied around a wearer's neck, said tool comprising a sheet of flexible, resilient material of sufficient size to be grasped by a human hand, said sheet being curved in the general shape of a half hollow cylinder without ends so as to have a concave surface and a convex surface, said sheet having a keel-like fin attached to and running along the entire length of the concave surface, said keel-like fin bisects a cavity formed by said concave surface of said sheet thereby forming two smaller cavities of equal size, said tool further comprises a semi-rigid cylindrical probe which narrows to a point at a first end and is attached to said keel-like fin by a second end, said probe forming a longitudinal extension of said keel-like fin outside said cavity formed by said concave surface.

* * * * *